United States Patent [19]

Anayama et al.

[11] Patent Number: 4,975,352

[45] Date of Patent: Dec. 4, 1990

[54] ELECTROPHOTOGRAPHIC PHOTOSENSITIVE MEMBER AND A METHOD OF PREPARING IT

[75] Inventors: Hideki Anayama; Takashi Koyama, both of Yokohama, Japan

[73] Assignee: Canon Kabushiki Kaisha, Tokyo, Japan

[21] Appl. No.: 512,569

[22] Filed: Apr. 24, 1990

Related U.S. Application Data

[63] Continuation of Ser. No. 199,707, May 27, 1988, abandoned.

[30] Foreign Application Priority Data

Jun. 1, 1987 [JP] Japan ..... 62-137974

[51] Int. Cl.[5] ..... G03G 5/06

[52] U.S. Cl. ..... 430/135; 430/137

[58] Field of Search ..... 430/135, 134, 137

[56] References Cited

U.S. PATENT DOCUMENTS

| | | | |
|---|---|---|---|
| 3,672,979 | 6/1972 | Gerace et al. | 430/135 |
| 4,735,882 | 4/1988 | Yamashita et al. | 430/58 |
| 4,743,523 | 5/1988 | Yamashita et al. | 430/59 |
| 4,788,119 | 11/1988 | Yamashita et al. | 430/58 |
| 4,810,607 | 3/1989 | Matsumoto et al. | 430/73 |

*Primary Examiner*—J. David Welsh

*Attorney, Agent, or Firm*—Fitzpatrick, Cella, Harper & Scinto

[57] ABSTRACT

An electrophotographic photosensitive member comprises a conductive support, and having thereon a charge generation layer formed by coating a coating solution containing a charge generating material dispersed in the time of a total dispersing time T in the range of the formula $4\ T_1 \geqq T \geqq 2\ T_1$, followed by drying, and a charge transport layer formed by coating a coating solution containing a charge-transporting material followed by drying and a method of preparing it.

10 Claims, 9 Drawing Sheets

ELECTROPHOTOGRAPHIC PHOTOSENSITIVE MEMBER AND A METHOD OF PREPARING IT

This application is a continuation of application Ser. No. 199,707 filed May 27, 1988, now abandoned.

BACKGROUND OF THE INVENTION

1. Field of the Invention

The present invention relates to an electrophotographic photosensitive member, and more particularly to a method of preparing an electrophotographic photosensitive member by use of a coating solution having good stability, and a method of preparing it.

2. Related Background Art

Electrophotography employs photoconductive materials comprising a support coated with a material having insulating properties in the dark and capable of changing its electrical resistance responding to the amount of irradiation received in the course of image exposure, as disclosed in U.S. Pat. No. 2,297,691. Basic characteristics required in electrophotographic photosensitive members using this photoconductive material are that (1) the photosensitive members can be charged to suitable potential in the dark, (2) they suffer less diffusing-away of electric charges in the dark, (3) the charge can be quickly diffused away by irradiation of light.

As electrophotographic photosensitive members, there have hitherto widely used inorganic photosensitive members having a photosensitive layer mainly comprised of an inorganic photoconductive compound such as selenium, zinc oxide and cadmium sulfide. These, however, though satisfying the above conditions (1) to (3), can not necessarily be satisfactory in the thermal stability, humidity resistance, durability, productivity, etc. For example, selenium, once it is crystallized, brings about deterioration of the properties as a photosensitive member, causing difficulties in the manufacture, and may be crystallized because of heat or fingerprints to deteriorate the performances as a photosensitive member. Also, in the case of cadmium sulfide, there are problems in the humidity resistance and durability, and, in the case of zinc oxide, in the smoothness, hardness and wear resistance. Moreover, many of inorganic photosensitive members have limits in photosensitivity wavelength regions. For example, selenium has a photosensitivity wavelength region in the blue region, and has little sensitivity to the red region. For this reason, various methods are proposed to expand the photosensitivity to a longer wavelength region, but with many limitations in selecting a photosensitivity wavelength region. Also when zinc oxide or cadmium sulfide is used in photosensitive members, it has in itself a narrow photosensitivity wavelength region, thus requiring addition of various sensitizing agents.

For the purpose of overcoming the disadvantages involved in these inorganic photosensitive members, development is recent years extensively made on electrophotographic photosensitive members mainly comprised of a variety of organic photoconductive compounds. For example, they include a photosensitive member having a charge generation layer and a charge transport layer containing triallylpyrazoline as disclosed in U.S. Pat. No. 3,871,882, and a photosensitive member having a charge generation layer comprising a derivative of perylene pigments and a charge transport layer comprising a condensate of 3-bromopyrene with formaldehyde as disclosed in U.S. Pat. No. 3,837,851.

Also already known as photosensitive members employing bisazo pigments or trisazo pigments as charge-generating materials are those disclosed in Japanese Patent Laid Open Applications Nos. 59-33445, 56-46237, 62-111294, etc. The organic photoconductive compounds can also freely change the spectral sensitivity of the photosensitive members employing the compounds. For example, a great number of publications teach that the photosensitive members employing phthalocyanine compounds have sensitivity nearly up to 800 nm. Also, azo pigments disclosed in Japanese Patent Laid-Open Applications Nos. 61-272754 and 56-167759 have a high sensitivity in the visible light region, and Japanese Patent Laid-Open Applications Nos. 57-195767 and 61-228453 disclose those having sensitivity up to the infrared region.

The organic photoconductive compounds also have advantages not only in the superiority in electrophotographic characteristics but also particularly in productivity. For example, the photosensitive members employing the inorganic compounds such as selenium and the amorphous silicon that is recent years attracting notices as a material for electrophotographic photosensitive members can be prepared at present time only by production methods having a low production efficiency as exemplified by vapor deposition and sputtering. In contrast with this, however, the electrophotographic photosensitive members employing the organic photoconductive compounds in the charge generation layer can be prepared by using simple coating methods.

As stated above, the electrophotographic photosensitive members employing the organic photoconductive compounds in the charge generation layer have many advantages in the electrophotographic characteristics and productivity. Particularly in regard to the productivity, they are far beyond the electrophotographic photosensitive members employing the inorganic compounds.

The reason why they have high productivity is that the charge generation layer can be formed on a support by use of simple coating methods as mentioned above, but required for that purpose is a coating solution in which the charge-generating materials have been homogeneously dispersed in a solvent. Particularly to carry out coating methods suited for mass production, as exemplified by dip coating, blade coating and Meyer bar coating, the charge-generating materials dispersed in the coating solution are required to be stable. Coating solutions actually used are prepared by dispersing the organic photoconductive compounds as described above and binders (such as polymer resins) with use of a dispersing means such as a ball mill, a sand mill and an attriter. This dispersing method may differ depending on various organic photoconductive compounds (i.e., organic pigments), but the fact is that optimum conditions (such as dispersing time and grinding power in dispersing) are often unknown before the dispersing is actually carried out, and appropriate dispersing conditions can be found with difficult unless trial and error are repeated, requiring much labor. The phenomenon that particle size is easily enlarged if the materials are dispersed to have a given particle size or that the viscosity of solutions becomes extraordinarily high, i.e., the stability of coating solutions, may also differ. This also depends on trial and error to be repeated and may differ depending on the organic photoconductive compounds to be used. Accordingly, it has been difficult to seek out the dispersing conditions under which an optimum stability can be shown. In the end, what has been hitherto aimed in the dispersing step is to atomize the organic pigments, and it is commonly practiced to stop the dispersing when a given particle size was achieved.

It has often occurred that allowing the coating solutions thus prepared to stand for storage or carrying out circulation or the like to actually make electrophotographic photosensitive members results in enlarging grain size with time or increase in viscosity to make the coating solutions unusable.

SUMMARY OF THE INVENTION

An object of the present invention is to provide a method of preparing an electrophotographic photosensitive member by use of a coating solution having good stability, obtained by dispersing an organic photoconductive compound.

Another object of the present invention is to provide a method of preparing an electrophotographic photosensitive member that can achieve superior productivity.

The objects of the present invention can be achieved by carrying out dispersing in a total dispersing time T satisfying the condition formula of $4\ T_1 \geqq T \geqq 2\ T_1$ with respect to a dispersing time $T_1$ by which particle size turns smallest in the time between a time $t_1$ by which a material is dispersed to a particle size of 0.5 μm and 10 $t_1$.

Namely, according to one aspect of the present invention, there is provided a method of preparing an electrophotographic photosensitive member having a layer containing a particulate charge-generating material, wherein a total dispersing time T required when preparing a coating solution for forming said layer is in the range of the following formula:

$$4T_1 \geqq T \geqq 2T_1$$

where $T_1$ represents a shortest dispersing time by which the charge-generating material being dispersed comes to have a smallest particle size in the time between a time $t_1$ by which it is dispersed to a particle size of 0.5 μm and 10 $t_1$.

According to another aspect of the present invention, there is provided an electrophotographic photosensitive member comprising a conductive support, and having thereon a charge generation layer formed by coating a coating solution containing a charge-generating material dispersed in the time of a total dispersing time T in the range of the following formula:

$$4T_1 \geqq T \geqq 2T_1$$

where $T_1$ represents a shortest dispersing time by which the charge-generating material being disperesed comes to have a smallest particle size in the time between a time $t_1$ by which it is dispersed to a particle size of 0.5 μm and 10 $t_1$; followed by drying, and a charge transport layer formed by coating a coating solution containing a charge-transporting material followed by drying.

DETAILED DESCRIPTION OF THE INVENTION

Figure 1:
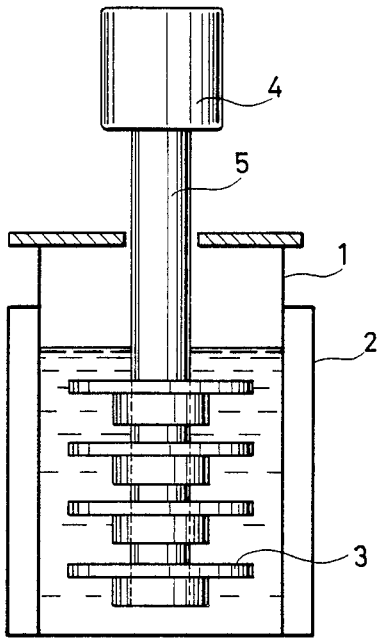
FIG. 1 is a schematic view illustrating the constitution of a wet sand mill apparatus used in working the present invention.

In the present invention, there is no particular limitation in the dispersing means itself. More specifically, dispersing can be achieved by using a wet dispersing apparatus such as a sand mill, a ball mill, a paint shaker and a homomixer, but desired from the viewpoint of the dispersing capacity and the grinding power required to effect dispersing is to carry out dispersing by using a sand mill.

Dispersing conditions, except for dispersing time, are required not to be varied in the course of dispersing. Taking an example in the sand mill, the factors variable in the course of dispersing, i.e., parameters with respect to dispersing, include (1) temperature and (2) grinding power. Other parameters may include the quantity and quality of the solution to be charged in, the quantity and quality of mediums to be used and the shape of the part at which the grinding power is actually applied to pigments. These are determined before carrying out the dispersing step, and can be said to be not varied at all in the course of dispersing. In contrast therewith, the above (1) temperature and (2) grinding powder are often varied in the course of dispersing. More specifically, the viscosity of dispersions increases with lowering of temperature to increase an apparent grinding power and lessen the time by which the dispersion particle diameter is made small to a given size. Rise of temperature results in the opposite. The grinding power, to straightforward describe, is shown as the rotational number of a disc or drum at the part at which dispersing is actually carried out. This indicates that since the grinding power simply and directly increases or decreases depending on the temperature, as a matter of course the time by which the dispersion particle diameter is made small to a given size comes to assume uncertainty, thus making it quite impossible to foresee when and in what quantity the materials are dispersed. For this reason, in instances where usual wet dispersing is carried out, the temperature is made constant by providing a jacket on the outside of a dispersing machine and the grinding power is made to give a constant grinding power by using a motor controlled in its rotational number. Here, in the case when the temperature and grinding power have been made constant, the time by which a certain organic pigment is dispersed to a given particle diameter can be said to equal the value inherent in the pigment. More specifically, this is the value obtained by fixing the above two parameters which are the factors of varying the dispersing time in the course of the dispersing step. For example, assuming as $T_O$ the time by which a certain pigment X is dispersed to an average particle diameter of 0.2 μm, $T_O$ always takes the same value if the temperature and grinding power are constant and the parameters determined before the dispersing step are same. Of course, if the parameters determined before the dispersing step are changed, the absolute value of $T_O$ changes. In other words, making large the diameter of medium to be used results in increase in the absolute value, and making large the quantity of the organic pigment with respect to a dispersion medium results in decrease in the absolute value of $T_O$, in this way.

The present invention found out the correlation existing between this dispersing time that can be said to be the value inherent in the organic pigment and the stability of a resulting dispersion (i.e., a coating solution), thus having reached the present invention.

First, dispersing is carried out by using a sand mill or the wet dispersing apparatus as described above. At this time, the time by which the particle diameter of the pigment comes to be 0.5 μm is assumed as $t_1$, and dispersing is carried out while observing the particle diameter until there lapses the time of 10 times the above time. Namely, the particle diameter that can bring about properties free of difficulties when usually used in a charge generation layer employing the organic pigment is near 0.5 μm experientially. This is because the particle diameter becoming larger than 0.5 μm or more as exemplified by 1 μm and 2 μm tends to result in generation of space charge in the charge generation layer to raise residual potential. Also, during duration, it often occurs that the residual potential becomes gradually larger even if there is no residual potential in the initial stage. To be exact, it differs depending on the type of the organic pigment used what particle diameter brings the residual potential to disappear, but, collectively reviewing the azo pigments as shown in Table 1, the rise of residual potential as mentioned above may very little occur. Also, the azo pigments typified by those shown in Table 1 are those made fine in the course of the dispersing time of from $t_1$ to 10 $t_1$ until their particle diameter has a certain bottom or shows a certain constant value. In other words, they are made fine to a certain level during this dispersing time, and in many cases the dispersing is terminated when the particle diameter reached the bottom or constant value. For this reason the dispersing time ranging from $t_1$ to 10 $t_1$ embraces the greater part of the dispersing time generally practiced, and a very large number of azo pigments show the bottom or constant value in their particle diameter within that time.

Then, assuming as $T_1$ the time by which the particle diameter of the pigment become smallest in the range of this dispersing time, the resulting dispersions can be made to be free of particle size enlargement, have less thixotropic properties and have very good stability.

In particular, among the azo pigments shown in Table 1, the disazo pigments or trisazo pigments of N-phenyl types whose central skeleton moiety has the structure such as

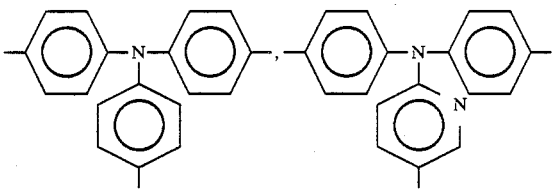

and

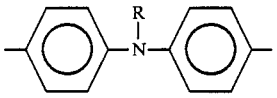

(R: H, $CH_3$) greatly tend to result in enlargement of particle size or increase in viscosity with time lapse if proper conditions for dispersing them are judged only based on apparent particle size. The present invention is very effective for the disazo pigments or trisazo pigments on which such judgement can be made with difficulty.

TABLE 1
| Central skeleton moiety of azo pigment | Coupler moiety of azo pigment |
|---|---|
| 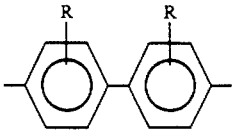 (R: H, Cl, $OCH_3$) | 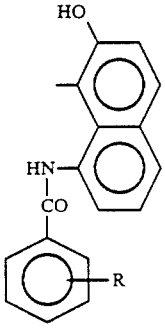 (R: H, halogen atom, alkoxy, alkyl, nitro or the like) |
| 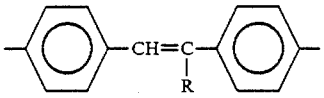 (R: H, CN) | |
| 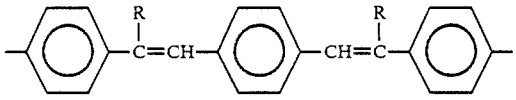 (R: H, CN) | 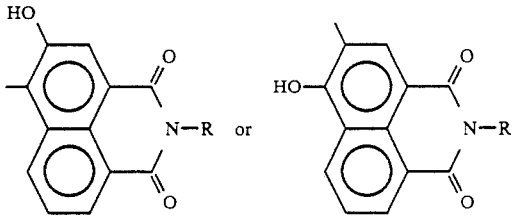 (R: alkyl, aryl or the like) |
| 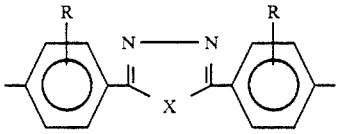 (X: O, S R: H, $CH_3$, Cl) | 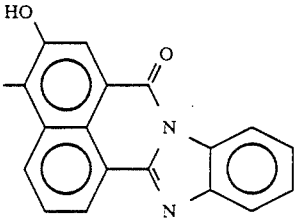 or |
| 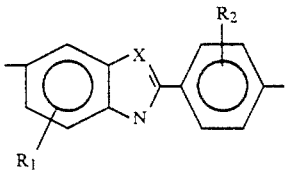 (X: O, S $R_1$, $R_2$: H, $CH_3$, Cl) | 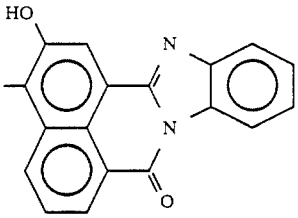 |
| 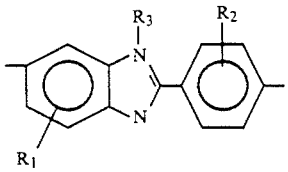 ($R_1$, $R_2$: H, $CH_3$, Cl, etc. $R_3$: H, $CH_3$, 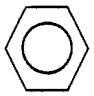 ) | 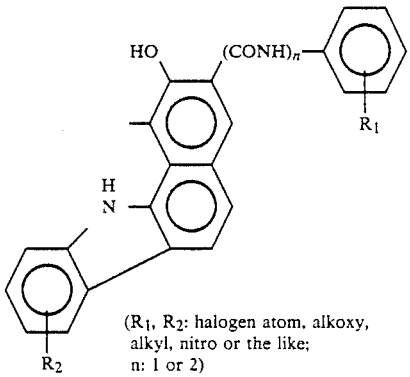 ($R_1$, $R_2$: halogen atom, alkoxy, alkyl, nitro or the like; n: 1 or 2) |
| 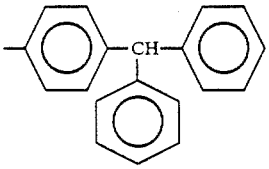 | |
| 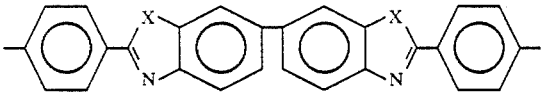 (X: O, S) | |

TABLE 1-continued
| Central skeleton moiety of azo pigment | Coupler moiety of azo pigment |
|---|---|
| 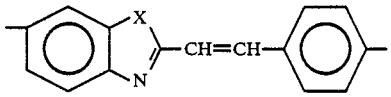 (X: O, S) | 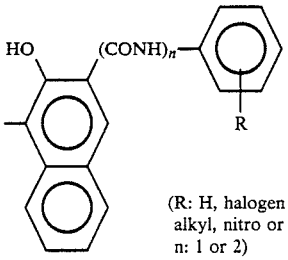 (R: H, halogen atom, alkoxy, alkyl, nitro or the like; n: 1 or 2) |
| 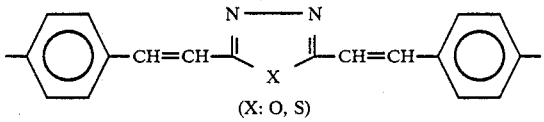 (X: O, S) | |
| 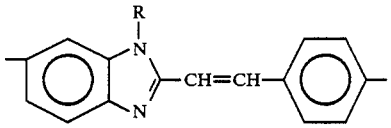 (R: H, $CH_3$) | 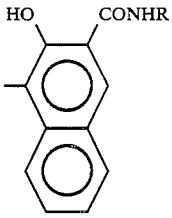 (R: $CH_3$, $C_2H_5$, $C_3H_7$) |
| 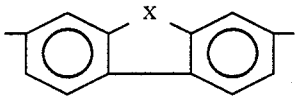 (X: $CH_2$, O, S, $SO_2$) | |
| 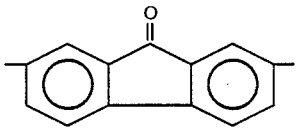 | 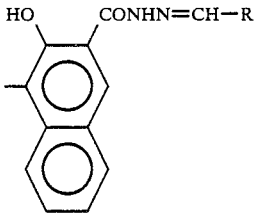 |
| 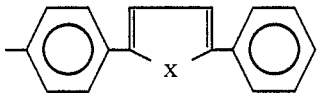 (X: O, S) | |
| 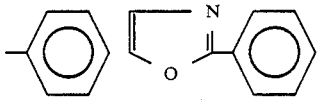 | 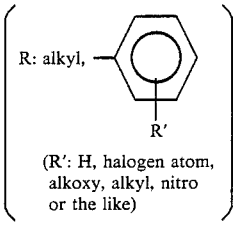 (R': H, halogen atom, alkoxy, alkyl, nitro or the like) |
| 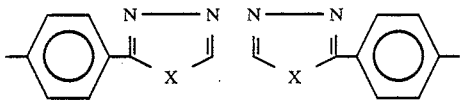 (R: O, S) | |
| 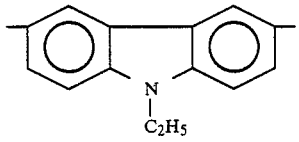 | |
| 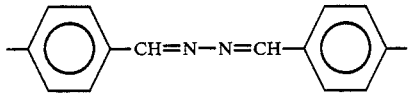 | |
| 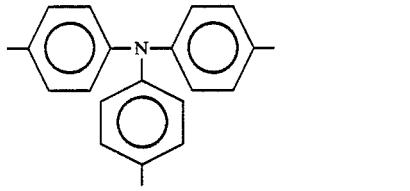 | |

TABLE 1-continued

| Central skeleton moiety of azo pigment | Coupler moiety of azo pigment |
|---|---|
| 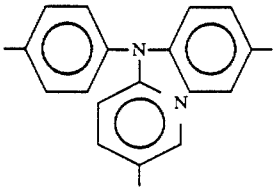 | |
| 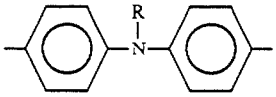 (R: H, $CH_3$) | |

The electrophotographic photosensitive member of the present invention comprises a photosensitive layer laminated on a conductive support, and this photosensitive layer may preferably be an organic photosensitive layer functionally separated into a charge generation layer and a charge transport layer.

The charge generation layer can be formed by dispersing and incorporating in the manner described above and in a suitable binder resin the azo pigment as described above, as well as orgnaic photoconductive materials such as phthalocyanine pigments, quinone pigments, pyranthrone pigments and anthanthrone pigments, as a charge-generating material, and coating the resulting dispersed coating solution followed by drying.

The charge transport layer can be formed by dissolving and incorporating in a suitable binder resin a charge-transporting material such as hydrazone compounds, pyrazoline compounds, styryl compounds and oxazole compounds, and coating the resulting coating solution followed by drying.

Used for the conductive support are metals such as aluminum, aluminum alloys and stainless steel, cylinder or film or sheet made of paper, plastics or the like.

Intermediate layer such as a conductive layer, an adhesion layer and a subbing layer may be further provided between the conductive support and photosensitive layer depending on the purposes of covering any defects of the support, improving charge injection properties, adhesion, etc.

The photosensitive layer may also comprise the single layer type that the charge-generating material and charge-transporting material are contained in the same layer.

EXAMPLES

The present invention will be described below in greater detail according to Examples.

EXAMPLE 1

Figure 2A:
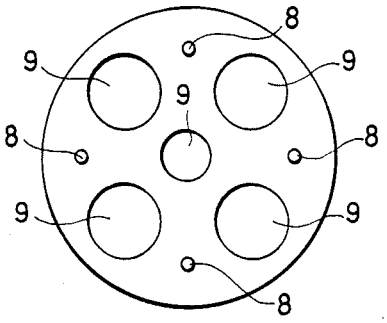
FIGS. 2A and 2B are a plan view (2A) and a side view (2B) of a dispersing disc of the above apparatus.
Figure 2B:
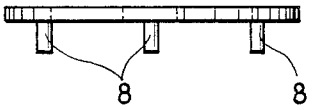
Figure 3:
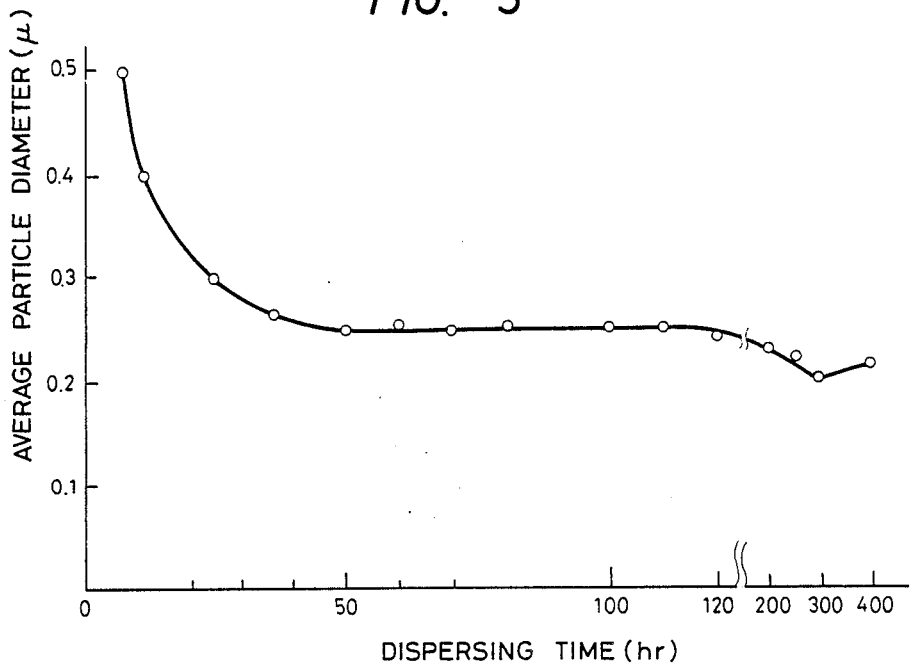
FIG. 3 is a graph showing the relationship between dispersing time and average grain size of a pigment in an Example of the present invention.

To 10 parts by weight of an organic pigment having the following structure:

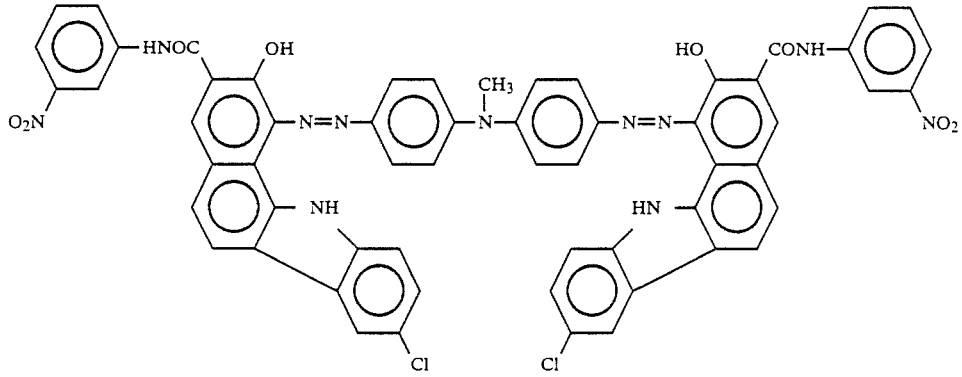

and 5 parts by weight of polymethyl methacrylate having a number average molecular weight of 21,000, 190 parts by weight of cyclohexanone were added and glass beads of 1 mm in diameter were charged in the proportion of 1 ml per 1 g of cyclohexane to carry out dispersing using a wet sand mill apparatus as shown in FIG. 1. In FIG. 1, the numeral 1 denotes a vessel; 2, a jacket; 3, a disc; 4, a driving unit; and 5, a shaft. The disc used here was the one having protrusions 8 on the bottom surface of the disc as illustrated in FIGS. 2A and 2B. Also in FIG. 2, the numeral 7 denotes a shaft-pierced part; 8, protrusions; and 9, convection holes. Temperature in dispersing was set to 23±1° C., and shaft rotational number, to 800 rpm. Changes in the dispersing time and average particle diameter observed at this time are shown in FIG. 3. The particle diameter was measured by using an ultracentrifugal automatic grain size distribution measuring apparatus (CAPA-700 type) available from Horiba Seisakusho. The concentration in measurement was not particularly prescribed, but a solution was prepared so that the absorbance of the solution may range from 0.7 to 0.9. Tetrahydrofuran was used to effect dilution. As to particle diameter, weight average particle diameter was used as a value for the particle diameter.

As will be clear from FIG. 3, the dispersing time required for the particle diameter to reach 0.5 μm is 7 hours. Here, the minimum dispersing time $T_1$ by which particle size turns smallest in the range of 7 to 70 hours is 50 hours. In other words, this pigment makes it possible to obtain a stable dispersed coating solution in 100 to 200 hours. Characteristics such as sedimentation ratio and particle size enlargement that actually contribute the stability will be described below.

In this dispersing procedure, sedimentation ratio (a value to show what % was held by settled solids among the solids in the solution) was measured by dispensing a part of the dispersion (coating solution), using a 50 ml centrifugal settling tube under centrifugal settling conditions of 4,000 rpm and 15 minutes. The coating solution thus dispensed was allowed to stand for a week at 23° C. to measure the viscosity after that with use of a rotor system Type B viscometer.

Figure 4:
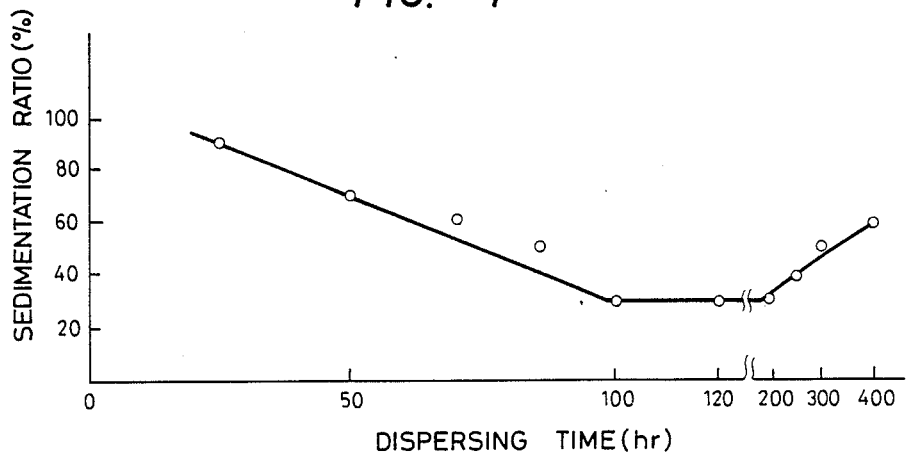
FIG. 4 is a graph showing the relationship between sedimentation rate and dispersing time of a dispersion in the above Example.
Figure 5:
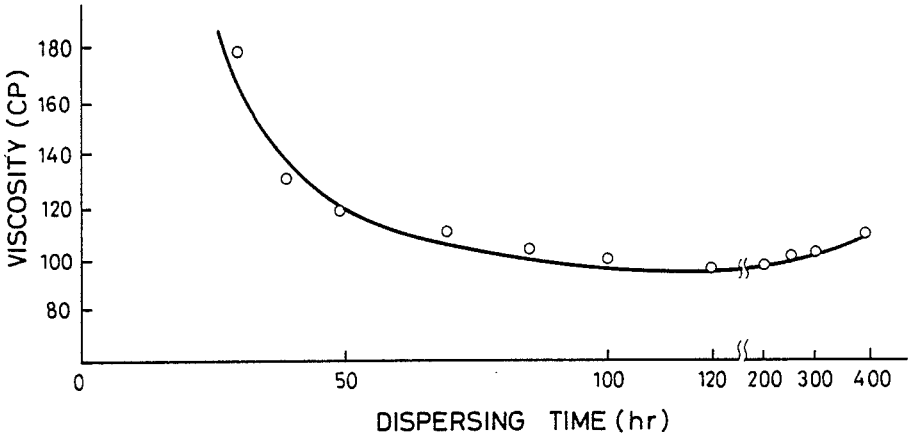
FIG. 5 is a graph similarly showing the relationship between viscosity and dispersing time of the same.

Results of the sedimentation ratio and viscosity are shown in FIG. 4 and FIG. 5. As shown in FIG. 4, the sedimentation ratio is substantially flat and in a low level in the dispersing time of from 100 to 200 hours. In contrast with this, a difference is seen to exist in the tendency of the sedimentation ratio in the region of 85 hours or less. The sedimentation ratio increases, though gradually, also in the region of 250 hours or more. As will be clear from FIG. 4, any homogeneous and stable dispersions can not yet obtained in the dispersing time of 85 hours or less, presumably resulting in formation of a sort of tough agglomeration to settle the pigment part. Also, the dispersing time of 250 hours or more constitutes a sort of over disperse region, where a gradual increase in the sedimentation ratio is seen.

FIG. 5 also allows to assume that the tough agglomeration or thixotropic increase probably takes place at the both ends of the bottom corresponding to 100 to 200 hours. In other words, in FIG. 5, the viscosity increases at the both sides of the bottom corresponding to the time between 100 and 200 hours.

Figure 6:
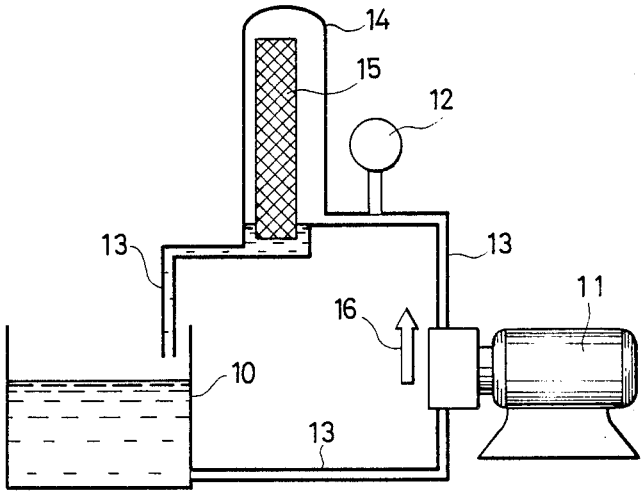
FIG. 6 is a schematic view illustrating the constitution of a coating solution circulation test machine.
Figure 7:
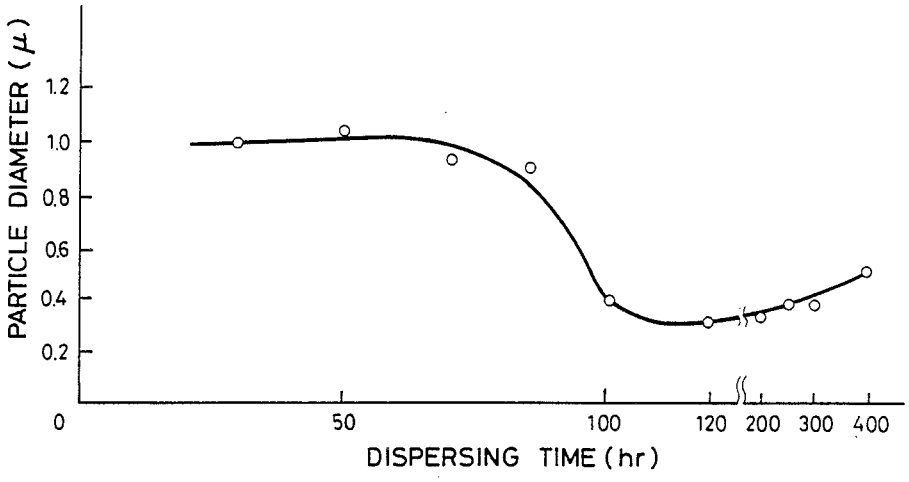
FIG. 7 is a graph showing the relationship between average particle diameter after circulation of the coating solution with use of the above test machine, and time.

Next, the coating solution available at each dispersing time was charged in a coating solution circulation test machine, and circulated under a circulation rate of 100 ml/min. In FIG. 6, the numeral 10 denotes a solution reservoir; 11, a diaphragm pump; 12, a pressure gauge; 13, a circulation piping system; 14, a filter housing; 15, a stainless steel mesh filter available from Paul Co.; and 16 indicates the direction of liquid flow (the filter used in the circulation was 40 μm). Circulation was carried out for 5 days using this circulation test machine, and thereafter the particle diameter was measured to obtain the results shown in FIG. 7. As will be clear from FIG. 7, the stability with time as a coating solution show the same tendency as the sedimentation ratio shown in FIG. 4. More specifically, it is seen that the particle diameter increases by less degree in the range of the dispersing time of from 100 to 200 hours, while there is a great tendency of enlarging grain size in the range outside this.

Actually the filter shown in the apparatus of FIG. 6 was replaced with a filter of 0.5 μm, whereupon the pigment part caused clogging of the filter in 48 hours except for solutions having the dispersing time of 100 hours or more, resulting in 1.0 kg/m$^2$ or more in the pressure indicated by the pressure gauge, but in contrast solutions of from 100 to 200 hours brought about no change seen in the pressure gauge even after circulation for 1 month. Also, a solution at 250 hours showed an increase in the gauge pressure to 0.5 kg/m$^2$ on the 20th day; and a solution at 300 hours, on the 25 day. They further exceeded a gauge pressure of 1 kg/m$^2$ on the 15th day and the 13th day, respectively.

To summarise the foregoing points, as will be clear from FIG. 3, the dispersing time (i.e., $T_1$) is 50 hours that is required for the particle diameter of pigment (1) available when pigment (1) is once simply dispersed to constitute an electrophotographic photosensitive member and peeled therefrom (i.e., an average particle diameter A of the charge-generating material), to turn to 0.29 μm. As will be clear from FIG. 4, FIG. 5, FIG. 7 and the above experiment in which the filter was replaced with the filter of 0.5 μm, the dispersing time in which the solutions show stable properties as dispersions ranges from 100 hours to 200 hours. Thus, carrying out dispersing in the time ranging from 2 times to 4 times the 50 hours represented by $T_1$ can obtain dispersed coating solutions having very good stability.

Next, in regard to dispersions of the dispersing time of 50 hours, 100 hours, 200 hours and 400 hours, coating solutions obtained after completion of dispersing and coating solutions obtained by circulation for 5 days using the coating solution circulation test machine illustrated in FIG. 6 were used to respectively prepare electrophotographic photosensitive members in the following manner.

First, an aluminum cylinder of 1 mm in wall thickness, 60 mm in outer diameter and 250 mm in length, applied with mirror surface processing was made ready for use as a conductive support, and this aluminum cylinder was washed with methyl ethyl ketone. Next, coating was carried out by a coating method in which the resulting aluminum cylinder was dipped in an ethanol solution of polyamide and drawn up in a constant rate (hereinafter called "dip coating"), followed by drying for 10 minutes at 80° C. to provide a subbing layer of 0.5 μm thick. Subsequently the dispersed coating solution was coated on this subbing layer by dip coating to have a thickness of 150 mg/m$^2$, followed by drying for 10 minutes at 80° C. to form a charge generation layer.

Further a charge-transporting material of the structural formula shown below:

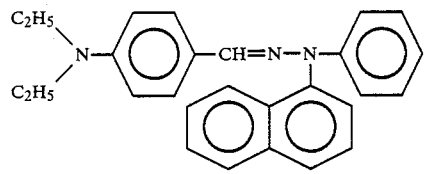

and bis-phenol type polycarbonate (particle size average molecular weight: 30,000) as a binder were dissolved in monochlorobenzene in the proportion of 1:1 in weigh ratio to prepare a coating solution, which was then coated on the above charge generation layer by dip coating, followed by drying for 60 minutes at 120° C. to form a charge transport layer of 20 μm thick.

Photosensitive member numbers of the electrophotographic photosensitive members thus prepared and dispersed coating solutions used are shown below.

| Photo-sensitive member No. | Dispersed coating solutions used in coating |
|---|---|
| 1 | Coating solution after completion of dispersing of 50 hour dispersing time. |
| 2 | Coating solution after completion of dispersing of 100 hour dispersing time. |
| 3 | Coating solution after completion of dispersing of 200 hour dispersing time. |
| 4 | Coating solution after completion of dispersing of 400 hour dispersing time. |
| 5 | Coating solution after circulation for 5 days, of solution of 50 hour dispersing time |
| 6 | Coating solution after circulation for 5 days, of solution of 100 hour dispersing time |
| 7 | Coating solution after circulation for 5 days, of solution of 200 hour dispersing time |
| 8 | Coating solution after circulation for 5 days, of solution of 400 hour dispersing time |

Each of these photosensitive members was mounted on a laser beam printer (LBP-CX; available from Canon K.K.) to carry out initial image production in an environment of 15° C. and 10% RH.

Image evaluation was made by visually observing an image-produced A4 size paper to make 7 rank system consisting of A (0 to 3), B (4 to 10), C (11 to 20), D (21 to 30), E (31 to 40), F (41 to 50) and G (more than 50) according to the number of dots of 1 mm or more in diameter in a 10 cm square area that is defined around a site at which the dots are most densely present.

As a result, photosensitive member No. 1 generated black dots (black points appearing on white ground areas) of rank C; and photosensitive member No. 5, rank D. In contrast with this, all other photosensitive members assigned rank A.

In the same environment, 2,000 sheet continuous feeding was further carried out to obtain the result that both of photosensitive members No. 1 and No. 5 generated black dots of rank G; and photosensitive member No. 8, rank E.

Shown below are results of characteristics evaluation on the initial dark portion potential and dark portion potential after 2,000 sheet continuous feeding of each photosensitive member.

| Photo-sensitive member No. | Initial dark portion potential (−V) | Dark portion potential after 2,000 sheet continuous feeding (−V) |
|---|---|---|
| 1 | 700 | 640 |
| 2 | 680 | 680 |
| 3 | 690 | 685 |
| 4 | 700 | 695 |
| 5 | 700 | 600 |
| 6 | 710 | 705 |
| 7 | 690 | 680 |
| 8 | 700 | 650 |

As shown above, the photosensitive member prepared by using the coating solutions having the dispersing time in the range of from 100 to 200 hours are free of any problem and superior in the image characteristics and potential characteristics.

In contrast therewith, photosensitive member No. 1 employing the coating solution having the dispersing time of 50 hours, even though it employs a coating solution obtained after completion of dispersing without circulation, generates black dots presumed to be caused by the agglomeration on a coating surface, and results in an extreme lowering of the retention of the dark portion potential when subjected to 2,000 sheet duration.

Photosensitive member No. 8 having no problem in the initial stage, as having a problem in the circulation stability of the coating solution, suffers agglomeration on the coating surface although not so serious in the No. 1 and No. 5 photosensitive members, accompanied by generation of black dots after duration even with no problem in the initial stage image.

EXAMPLES 2 & 3

Similar experiments were carried out also on other pigments to attempt to examine the dispersing time and stability.

Studies similar to those in Example 1 were made on pigment (2) as Example 2 and pigment (3) as Example 3.

(2)

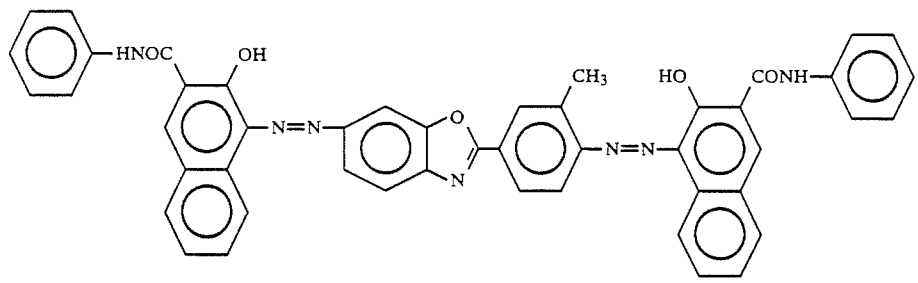

-continued (3)

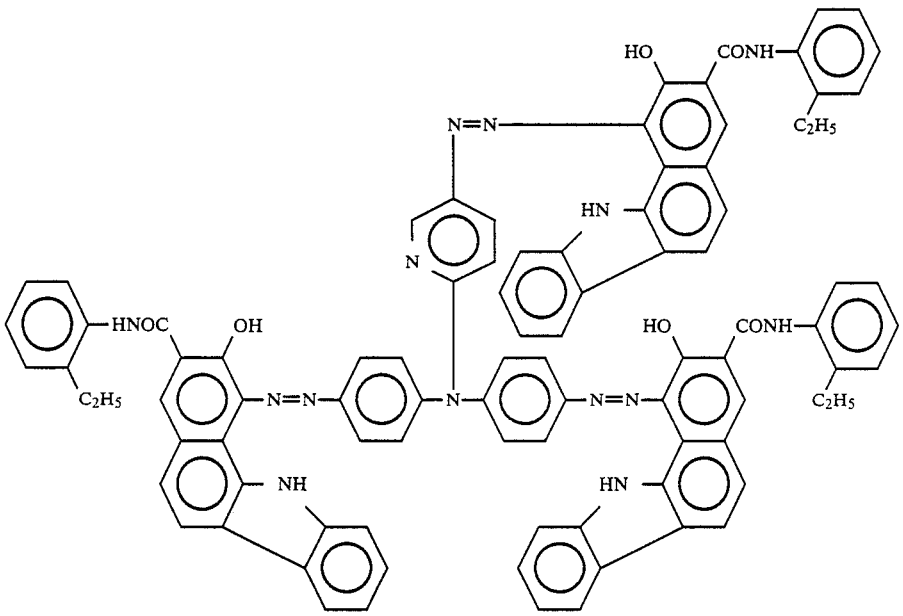

More specifically, measurement was made in the same manner as in Example 1 to examine the relationship between the dispersing time and the dispersion particle diameter, sedimentation ratio, viscosity or average particle diameter after circulation. Results on pigment (2) are shown in FIG. 8 and FIG. 10 to FIG. 12, and results on pigment (3), in FIG. 9 and FIG. 13 to FIG. 15.

Figure 8:
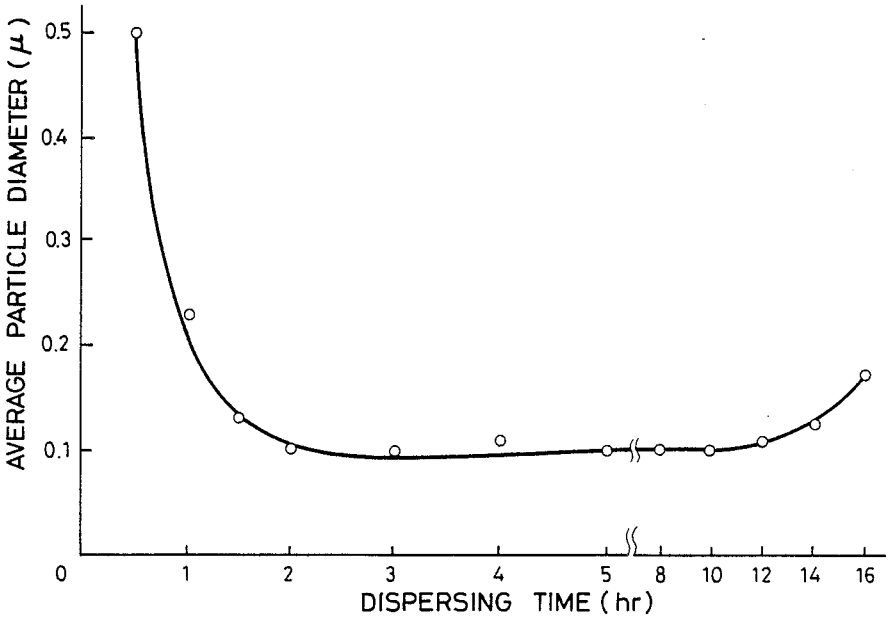
FIG. 8 is a graph showing a dispersion curve 36 pigment (2)

Like Example 1, it is clear from FIG. 8 that $T_1$ can be read to be 2 hours.

Figure 10:
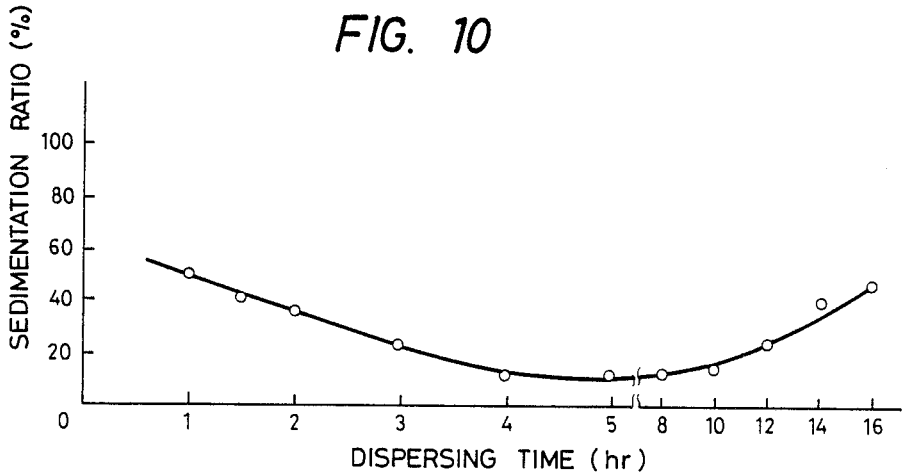
FIG. 10 is a graph showing the relationship between sedimentation ratio and dispersing time of pigment (2)
Figure 11:
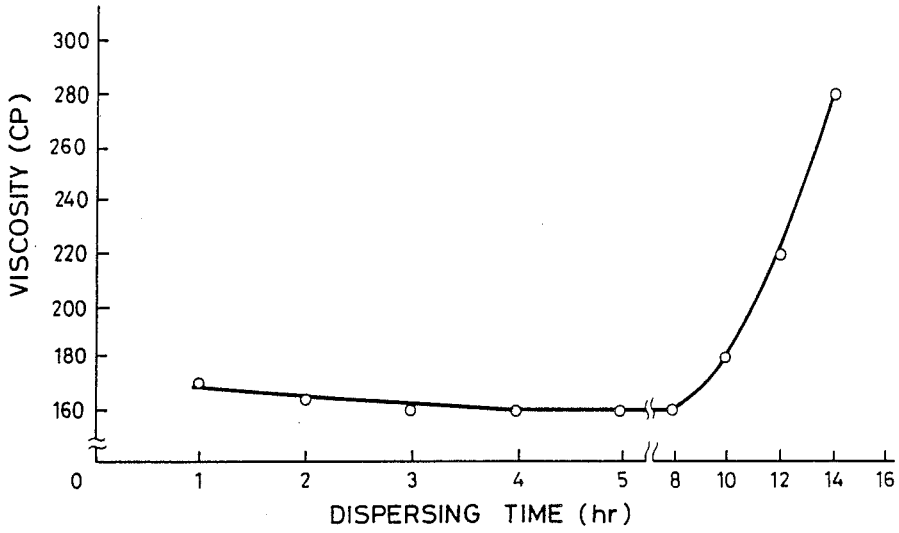
FIG. 11 is a graph showing the relationship between viscosity and dispersing time of pigment (2)
Figure 12:
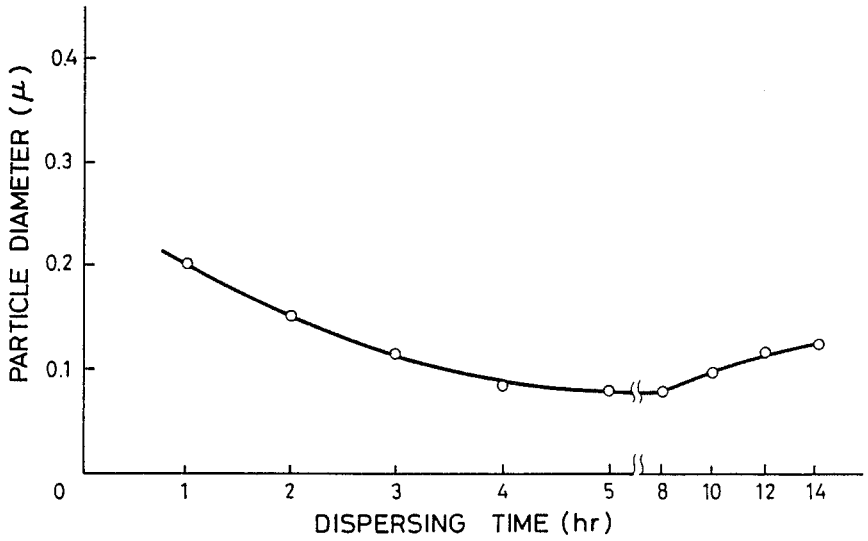
FIG. 12 is a graph showing the relationship between particle diameter after circulation and dispersing time of pigment (2)

As will be clearly seen from FIG. 10 to FIG. 12, this pigment shows stable characteristics in the dispersing time of 4 to 8 hours. Both the sedimentation ratio and particle diameter follows a slowly downward line at the part of less dispersing time, but the viscosity is seen to abruptly increase with increase in the dispersing time, resulting in increase in the thixotropic properties of the solution.

Figure 16:
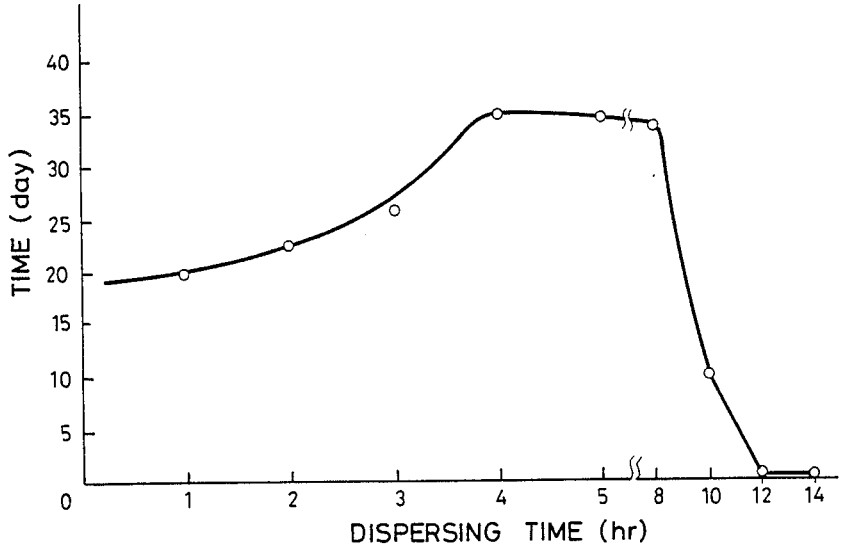
FIG. 16 is a graph showing the time by which the pressure indicated by a pressure gauge reached 1 $kG/m^2$ in the circulation apparatus of FIG. 6.

Circulation was also carried out under the same conditions as in Example 1 and using the circulation apparatus shown in FIG. 6. The time required for the pressure of the pressure gauge to reach 1 kg/m$^2$ is shown in FIG. 16. As will be clear from FIG. 16, because of the thixotropic properties the coating solution of the dispersing time of 10 hours or more very rapidly forms an agglomerated state, and is impossible to be stored as a coating solution.

From these items, it is clear that the most proper dispersing time ranges from 4 to 8 hours also in respect of pigment (2).

Figure 9:
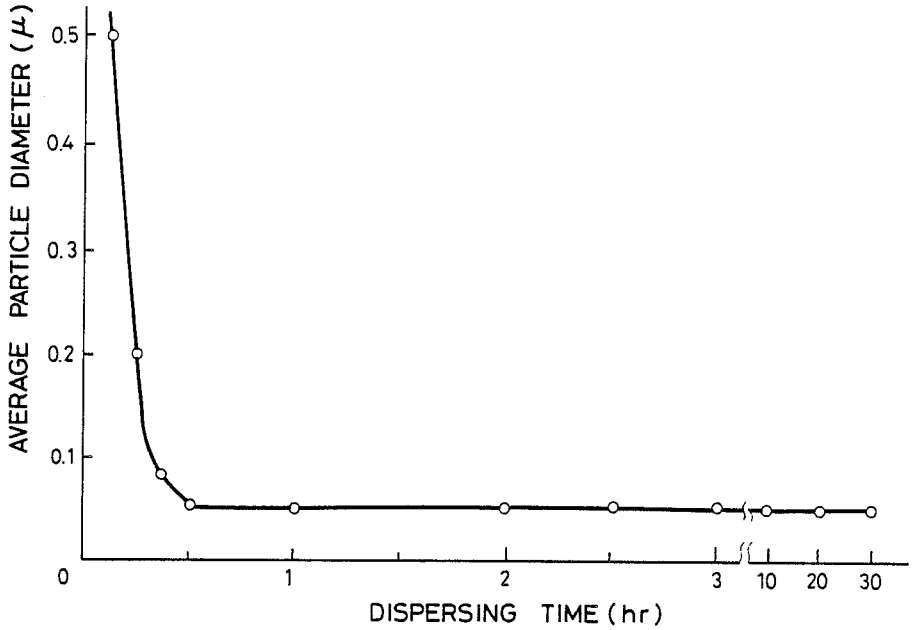
FIG. 9 is a graph showing a dispersion curve of pigment (3)

As to pigment (3), FIG. 9 shows that what corresponds to the dispersing time $T_1$ is 30 minutes.

Figure 13:
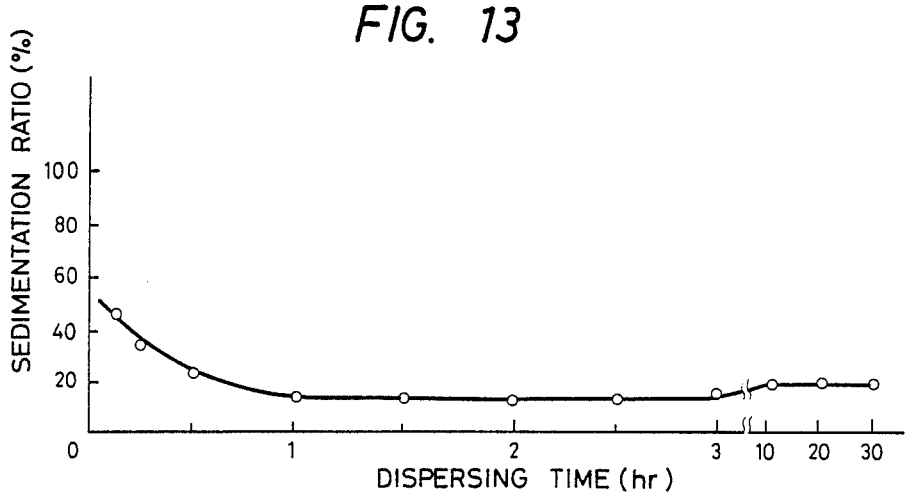
FIG. 13 is a graph showing the relationship between sedimentation ratio and dispersing time of pigment (3)
Figure 14:
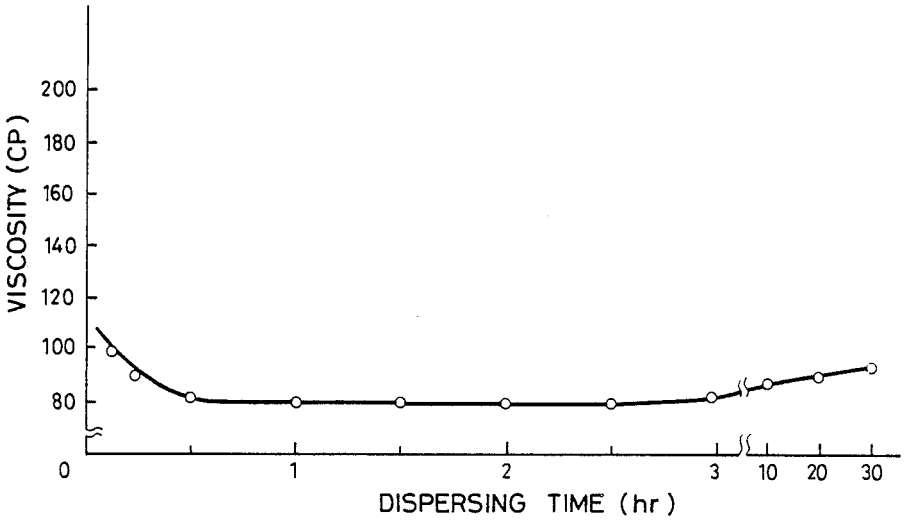
FIG. 14 is a graph showing the relationship between viscosity and dispersing time of pigment (3)
Figure 15:
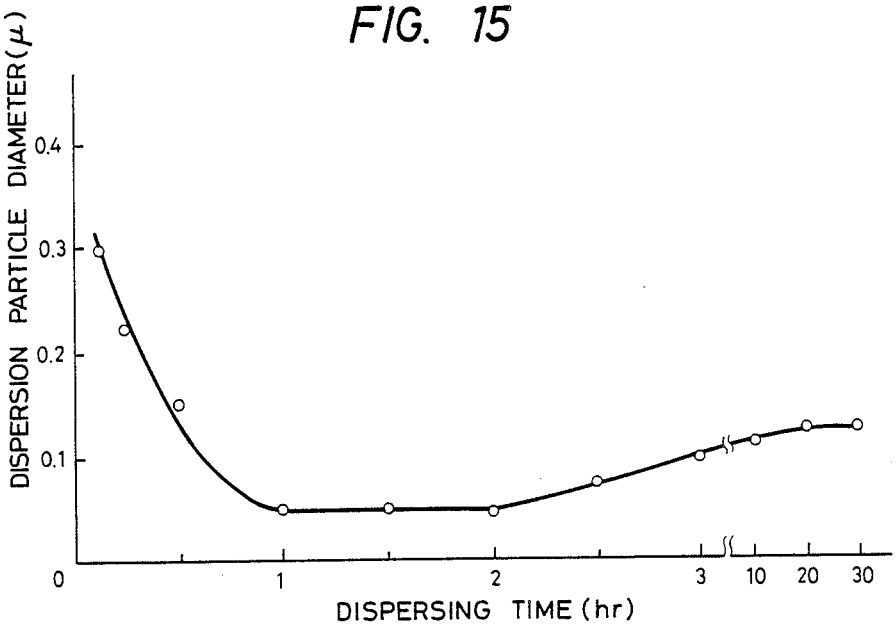
FIG. 15 is a graph showing the relationship between particle diameter after circulation and dispersing time of pigment (3)

Similar to Examples 1 and 2, the results on the items with respect to the dispersing time are shown in FIG. 13 to FIG. 15. As will be seen in FIG. 13 and FIG. 14, no increase in the thixotropic properties at the over disperse region is observed in this pigment, and judgement from FIG. 13 and FIG. 14 shows that the coating solution appears to be sufficiently stable with the dispersing time of 30 minutes or more.

However, as shown in FIG. 15, a considerably remarkable difference is seen in the change in particle diameter after circulation. More specifically, the particle diameter tends to be enlarged at both sides of the bottom corresponding to the dispersing time of from 1 hour to 2 hours.

Similar to Examples 1 and 2, the filter of the circulation apparatus of FIG. 6 was further replaced with a filter of 0.5 μm to carry out the circulation test. As a result, there was seen no increase in the pressure of the pressure gauge as shown in FIG. 16 which is different from that in Examples 1 and 2.

Provided that adhesion of a pigment was seen on the filter surface, and it actually occurred that solids content decreased in the course of the circulation. Although the reason therefor is unclear, this is presumably due to the difference between disazo pigment and trisazo pigment.

Figure 17:
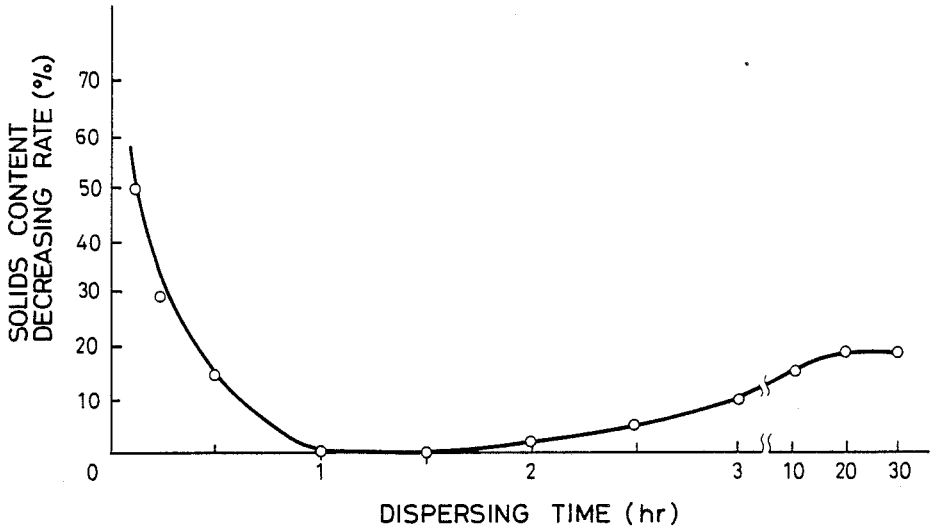
FIG. 17 is a graph showing the relationship between dispersing time and solids content decreasing rate in a coating solution.

FIG. 17 shows the relationship between the dispersing time and solids content decreasing rate (showing what % of the solids content charged in was adhered on the filter). As will be clear therefrom, the solids content decreasing rate reaches the bottom at the region of from 1 to 1.5 hours. The solids content successively decreases in the dispersing for 3 hours or more and the dispersing for 30 minutes or less, making it difficult to store or carry out coating as a stable solution.

Accordingly, also in pigment (3), the dispersing time of from at least 1 hour to 2 hours makes it possible to obtain a stable coating solution.

Example 1 was repeated to prepare electrophotographic photosensitive members, except that the dispersed coating solutions in Example 2 were used.

Conditions for the dispersed coating solutions used in the coating and photosensitive member numbers are shown below.

| Photosensitive member No. | Dispersed coating solutions used in coating |
|---|---|
| 9 | Coating solution after completion of dispersing of 2 hour dispersing time. |
| 10 | Coating solution after completion of dispersing of 5 hour dispersing time. |

-continued

| Photosensitive member No. | Dispersed coating solutions used in coating |
|---|---|
| 11 | Coating solution after completion of dispersing of 12 hour dispersing time. |
| 12 | Coating solution after circulation for 10 days, of solution of 2 hour dispersing time |
| 13 | Coating solution after circulation for 10 days, of solution of 12 hour dispersing time |

Example was also repeated to prepare electrophotographic photosensitive members, except that the dispersed coating solutions in Example 3 were used.

Conditions for the dispersed coating solutions used and photosensitive member numbers are shown below.

| Photosensitive member No. | Dispersed coating solutions used in coating |
|---|---|
| 14 | Coating solution after completion of dispersing of 30 minute dispersing time. |
| 15 | Coating solution after completion of dispersing of 1 hour dispersing time. |
| 16 | Coating solution after completion of dispersing of 30 hour dispersing time. |
| 17 | Coating solution after circulation for 20 days, of solution of 30 min. dispersing time |
| 18 | Coating solution after circulation for 20 days, of solution of 1 hour dispersing time |
| 19 | Coating solution after circulation for 20 days, of solution of 30 hour dispersing time |

Photosensitive members Nos. 9 to 13 were mounted on a copying machine (PC-10, available from Canon K.K.) to carry out black image production in an environment of 30° C. and 80% RH. As a result, the No. 9 photosensitive member generated white dots (white dots on black ground areas) of rank D; and the No. 11 photosensitive member, rank E; the No. 12 photosensitive member, rank D. In contrast with this, the No. 10 photosensitive member produced a good image of rank A free of any problem.

Photosensitive members No. 14 to 19 were also mounted on a laser beam printer in the same manner as in Example 1 to carry out respectively the image production in an environment of 15° C. and 10% RH. As a result, the No. 17 photosensitive member generated black dots of rank E: and the No. 19 photosensitive member, rank F.

As shown above, in Example 2 the photosensitive members of the dispersing time of from 4 to 8 hours had no problem on images, but in contrast, other photosensitive members than these necessarily cause defects on images even in those employing the coating solutions available immediately after completion of dispersing.

Also, in Example 3, it is difficult to find any difference on images in regard to the photosensitive members employing the coating solutions available immediately after completion of dispersing. However, in the photosensitive members employing the coating solutions obtained by circulating dispersions having the dispersing time outside 1 to 2 hours, the azo pigments have tendency of grain size enlargement. Therefore, there is seen great agglomeration on the coating surfaces of the photosensitive members, resulting in generation of black dots that are image defects caused by this agglomeration.

What is claimed is:

1. A method of preparing an electrophotographic photosensitive member having a layer containing a particulate organic photoconductive charge-generating material, wherein a total dispersing time T in hours required when preparing a coating solution for forming said layer is in the range of the following formula:

$$4T_1 \geqq T \geqq 2T_1$$

where $T_1$ represents a shortest dispersing time in hours by which the charge-generating material being dispersed has a smallest particle size in the time between a time $t_1$ in hours by which it is dispersed to a particle size of 0.5 μm and $10t_1$; wherein said dispersing of said organic photoconductive charge generating material in preparing said coating solution is conducted under uniform conditions during the total dispersing time T.

2. The method of preparing an electrophotographic photosensitive member of claim 1, wherein said charge-generating material comprises an azo pigment.

3. The method of preparing an electrophotographic photosensitive member of claim 1, wherein a charge transport layer is provided on said layer containing the particulate charge-generating material.

4. The method of preparing an electrophotographic photosensitive member of claim 2, wherein said azo pigment is an N-phenyl type disazo pigment or trisazo pigment.

5. The method of preparing an electrophotographic photosensitive member of claim 2, wherein the structure of the central skeleton moiety of said azo pigment is selected from the group consisting of;

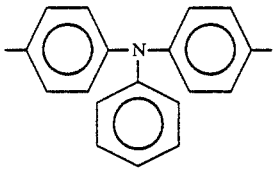

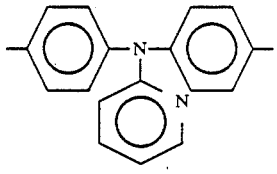

and

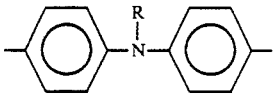

(R: H or $CH_3$)

6. An electrophotographic photosensitive member comprising a conductive support and having thereon a charge generation layer formed by coating a coating solution containing an organic photoconductive charge-generating material dispersed in the time of a total dispersing time T in hours in the range of the following formula:

$$4T_1 \geqq T \geqq 2T_1$$

where $T_1$ represents a shortest dispersing time in hours by which the charge-generating material being dispersed has a smallest particle size in the time between a time $t_1$ in hours by which it is dispersed to a particle size of 0.5 μm and $10t_1$; followed by drying, and a charge transport layer formed by coating a coating solution containing a charge-transporting material followed by drying; wherein said dispersing of said organic photoconductive charge generating material in preparing said coating solution is conducted under uniform conditions during the total dispersing time T.

7. The electrophotographic photosensitive member of claim 6, wherein said charge-generating material comprises an azo pigment.

8. The electrophotographic photosensitive member of claim 6, wherein a charge transport layer is provided on said layer containing the particulate charge-generating material.

9. The electrophotographic photosensitive member of claim 7, wherein said azo pigment is an N-phenyl type disazo pigment or trisazo pigment.

10. The electrophotographic photosensitive member of claim 7, wherein the structure of the central skeleton moiety of said azo pigment is selected from the group consisting of;

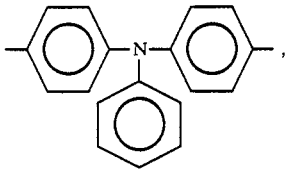

,

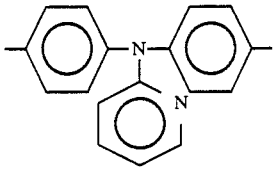

and

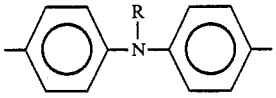

(R: H or $CH_3$)

* * * * *